United States Patent [19]

Dannhorn et al.

[11] 4,343,777

[45] Aug. 10, 1982

[54] METHOD OF SCRUBBING ACID GASES CONTAINING POLYMERIZABLE ORGANIC COMPONENTS

[75] Inventors: Erich Dannhorn, Wolfratshausen; Karl Baur, Buchenhain, both of Fed. Rep. of Germany

[73] Assignee: Linde Aktiengesellschaft, Wiesbaden, Fed. Rep. of Germany

[21] Appl. No.: 73,087

[22] Filed: Sep. 6, 1979

[30] Foreign Application Priority Data

Sep. 7, 1978 [DE] Fed. Rep. of Germany ..... 2839055

[51] Int. Cl.[3] ..... B01D 53/34

[52] U.S. Cl. ..... 423/228; 423/226; 423/229; 55/73

[58] Field of Search ..... 423/220, 223, 224, 226, 423/228, 229, 232; 55/68, 73

[56] References Cited

U.S. PATENT DOCUMENTS 2,607,657 8/1952 Bechtold et al. ..... 423/229
2,975,026 3/1961 Mills ..... 423/226
3,911,082 10/1975 Rottmayr et al. ..... 423/226
3,926,591 12/1975 Wildmoser et al. ..... 423/229 X
4,113,837 9/1978 Kendall et al. ..... 423/226

*Primary Examiner*—Earl C. Thomas
*Attorney, Agent, or Firm*—Karl F. Ross

[57] ABSTRACT

A process for scrubbing acid gases in which carbon dioxide and hydrogen sulfide, for example, are scrubbed from gas mixtures which also contain polymerizable organic components, in which an aqueous alkanolamine, such as ethanolamine, is used as the scrubbing liquid. The scrubbing liquid is heated, regenerated, cooled and returned to the scrubber and the polymerizable component or the polymer formed therefrom is removed by treating the scrubbing liquid with an organic solvent which is water immiscible. The extraction treatment by the organic solvent, according to the invention, is carried out after the heating and before the regeneration of the charged scrubbing liquid at a temperature of the latter which is just below the boiling point of the liquid mixture formed by the scrubbing liquid and the organic extracting solvent.

5 Claims, 2 Drawing Figures

METHOD OF SCRUBBING ACID GASES CONTAINING POLYMERIZABLE ORGANIC COMPONENTS

FIELD OF THE INVENTION

The present invention relates to a method of scrubbing gas mixtures to remove acid gases, especially carbon dioxide and hydrogen sulfide, therefrom, the gas mixtures also containing organic components which are polymerizable and are referred to hereinafter as polymerizable components.

BACKGROUND OF THE INVENTION

It is known to scrub acid gases, especially carbon dioxide and hydrogen sulfide, from gas mixtures which can also include polymerizable organic components, with an aqueous scrubbing liquid in which a key component is an alkanolamine such as ethanolamine.

Such a system has been described in German Pat. No. 19 24 052.

In this process, the scrubbing liquid, following the scrubbing operation, is heated, is regenerated (to remove the carbon dioxide and hydrogen sulfide), is cooled and is returned to the scrubber.

The polymerizable components or polymers or polymerizates formed therefrom are removed from the scrubbing liquid with a water immiscible organic solvent which is used to extract the scrubbing liquid.

This process can be used to remove carbon dioxide and hydrogen sulfide from cracking gases which are produced by a partial oxidation or pyrolysis of hydrocarbon mixtures. While this publication describes washing liquids which can be solutions of potash, alkanolamines or aminoacid salts, best results were found in this system with aminocarbonic acid salts, aminosulfonic acid salts or aminocarboxylic acid salts which have a high absorption coefficient for the acid gases as well as a low pickup of hydrocarbons. These latter scrubbing agents are also easily regenerated.

A special problem, however, arises when the scrubbing process encounters in the raw gas resin-forming agents, especially dienes, higher trienes or acetylenes, unsaturated polycyclic and heterocyclic components and other polymerizable organic components which can also include sulfur-containing organic compounds.

These are carried with the scrubbing liquid into the regenerating apparatus and tend to react in the latter with heating to form polymers which are insoluble in the scrubbing liquid and deposit in the regenerating column, in the cooler downstream thereof and in the boiler which is provided in the sump of the regenerating column to heat the liquid phase.

To overcome this disadvantage it has been proposed in the prior process to remove the polymerizable components with the aid of a water immiscible organic solvent which is used to extract the scrubbing liquid.

For the extraction of the polymerizable components by the conventional process, there are three techniques which have been proposed.

Firstly, the extraction is carried out directly in conjunction with the scrubbing operation in an extraction column provided immediately downstream of the scrubbing column at the temperature at which scrubbing is effected. The extracting solution is thus contacted with the scrubbing liquid only in the extraction column at the scrubbing temperature prior to heating of the charged scrubbing liquid to the regeneration temperature. This has the disadvantage that the extraction effectiveness at the relatively low scrubbing temperature is much less than optimum.

A second technique which has been proposed is to carry out the extraction directly in the regenerating column. The pure extraction solvent is introduced into the head of the regenerating column and trickles downwardly in the direction of flow of the charged washing liquid through the packing of the regenerating column. A portion of the aqueous scrubbing liquid is heated at the bottom of the column to produce a vapor phase which rises through the packing. The principal disadvantage of this technique is that the regenerating column must handle not only all of the scrubbing liquid but also all of the organic solvent serving as the extracting medium. A portion of the extracting solvent, by contact with the rising hot vapors, is also converted into the vapor phase and must be cooled and condensed at the head of the regenerating column to be recovered.

For efficient operation, the regenerating column must be dimensioned significantly larger than would be the case for the processing only of the scrubbing liquid and the construction of the column is further complicated by the need for providing a phase-separating device at the lower portion of the column so that the organic solvent can be removed from the aqueous mixture.

The refluxing and condensing device at the head of the regenerating column must be designed to permit not only condensation of vapors of the scrubbing liquid but also vapors of the extracting solvent. Finally, operation of the system is complicated by the fact that one must deal with a two-phase mixture rather than a single gas-solubilizing liquid phase in the form of the scrubbing liquid.

In a third alternative, the organic solvent serving as the extracting agent is circulated together with the scrubbing liquid throughout the scrubbing-liquid circulating path. The clean extraction solvent is supplied together with the regenerated scrubbing liquid at the head of the scrubbing column and both liquids are withdrawn together from the sump of the scrubbing column, are heated, are passed through the regenerating column and are further cooled. Thereafter a portion of the liquid mixture is withdrawn from the circulation and separated in a phase separator into an aqueous scrubbing-liquid phase and an extraction-solvent phase containing the polymerizable components. The scrubbing liquid component is returned to the liquid mixture withdrawn from the sump of the regenerating column while the extraction solvent portion is, after removal of the polymerizable components, returned to the head of the scrubbing column.

In this process, apart from the obvious disadvantage that the regeneration of the scrubbing liquid is loaded with the full amount of the extracting solvent as described previously, the circulating system must be dimensioned to deal with all of the extracting solvent as well as with the scrubbing liquid. This increases the required pump capacities and the power consumption of the system.

Since the extracting solvent is not fully treated after picking up the polymerizable components, there is an incomplete removal of the latter components and as a result the volume rate of flow of the extracting solvent must be greater.

OBJECTS OF THE INVENTION

It is the principal object of the present invention to provide a process for the scrubbing of acid gases from gas mixtures which is free from the disadvantages of the earlier system described above.

Another object of the invention is to provide a method of scrubbing acid gases, especially carbon dioxide and hydrogen sulfide, from gas mixtures containing polymerizable components whereby the extraction of these components is improved and made more economical than is the case with the earlier systems.

SUMMARY OF THE INVENTION

These objects and others which will become apparent hereinafter are attained, in accordance with the present invention, in a system of the type described using alkanolamine solutions which are less expensive than the preferred solutions of the prior art which include aminoacid salts, and in which the extraction treatment of the scrubbing liquid is carried out after the heating and before the regeneration of the charged scrubbing liquid at a temperature which is slightly below the boiling point of the mixture formed between the charged scrubbing liquid and the organic solvent serving as the extraction liquid.

According to the invention, therefore, the extraction treatment of the charged scrubbing liquid is carried out completely prior to the regeneration and at a temperature which is as close as possible to, but below, the point at which boiling commences of the liquid mixture formed between the extraction solvent and the scrubbing liquid.

Thus the possibility that the regeneration will be unnecessarily loaded or the total scrubbing cycle will be unnecessarily loaded by the extraction solvent is excluded and, on the contrary, it is ensured that the organic medium used as the extraction solvent will be utilized at an optimum temperature and fully without unnecessary increases in the volume rate of flow of the solvent. This ensures substantially complete removal of the polymerizable components without the use of unnecessarily large quantities of the organic solvent.

Since the extraction effectiveness increases with increasing temperature continuously, the treatment of the present invention is carried out at the highest possible temperature below which neither portions of the organic solvent nor portions of the scrubbing liquid are transformed into the vapor phase.

When the scrubbing liquid is a strongly aqueous monoethanolamine solution, the organic solvent should have a boiling point above 100° C. so that the mixture of the two liquids will have a boiling point which begins above 100° C. The extraction treatment is then carried out at temperatures above 60° C. and preferably above 80° C.

The extraction effect by utilizing a temperature below about 100° C. is thus lower by only about 6 or 15% at temperatures of about 60° C. and about 80° C. respectively.

The use of alkanolamines in place of the preferred aminoacid salts of the prior art has been found not be a disadvantage in the effective recovery of the acid components from the gas mixture.

When the acid gases are to be scrubbed from a gas mixture formed by the cracking of hydrocarbon mixtures resulting from a cracking operation in which the cracking gases are cooled so that higher-boiling components are separated in contact with a liquid benzine fraction (gasoline fraction) and the liquid benzine fraction is recovered upon the separation of the higher-boiling-point components from the gaseous residue, a portion of the liquid benzine fraction can be utilized as the organic solvent for the extraction of the scrubbing liquid and thereafter can be fed to the separating stage for the higher-boiling components from the cooled cracking gases. The thus-used portion of the gasoline fraction contains, after the extraction of the alkanolamine solution, the polymerizable components as well as a certain amount of entrained or solubilized alkanolamine.

Since the extraction treatment is carried out at elevated temperatures which practically ensure polymerization of the polymerizable components, the latter abound in the benzene fraction primarily in the form of high molecular weight polymerizates or polymers. When the benzine fraction is then returned to the separation of the higher-boiling components, the polymerizates are recovered together the liquid fraction from the sump of the separating column while the alkanolamine together with the gas mixture to be fed to the alkanolamine scrubber is recovered from the top of this column. The presence of the alkanolamine in this gas mixture is not disadvantageous since this gas mixture is then subjected to the scrubbing with the alkanolamine-containing scrubbing solution.

The process of the present invention can also be carried out by providing the extraction column immediately downstream of the scrubber after heating the scrubbed solution with the organic solvent serving as the extracting agent being circulated in a closed path in which a distillation column is provided. From the head of the distillation column, the extracted polymerizable components are recovered. When the system of the present invention is used, the polymerizable components, because of the high temperature at which the extraction is carried out, are in the form of high molecular polymerizate which allows the organic solvent together with any solubilized alkanolamine to be recovered at the head of the column while the high-molecular-weight polymerizate is found in the column sump. With recirculation of the head product, the recycled organic solvent will develop a relatively high alkanolamine concentration which precludes further pickup of alkanolamine from the scrubbing liquid without detrimentally affecting the extraction operation by the organic solvent.

Accordingly, it is a feature of the invention that the organic solvent, after taking up the extracted material at least in part in the form of a high-molecular-weight polymerizate, is subjected to a distillation in a distillation stage in which the high-molecular-weight polymerizate is recovered from the sump of the distillation with the head product being recycled to the heated charged scrubbing liquid, the alkanolamine picked up by the organic solvent being withdrawn as well from the head of the distillation stage.

An apparatus for carrying out the present invention can comprise, as described in the German Pat. No. 19 51 751 mentioned previously, a scrubbing column which is connected at its bottom with a regenerating column as well as a heat exchanger, a mixing zone and a separating vessel, the system of the present invention deviating from the prior-art apparatus in that the heat exchanger is provided between the bottom of the scrubbing column on the one hand and the mixing zone on the other.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
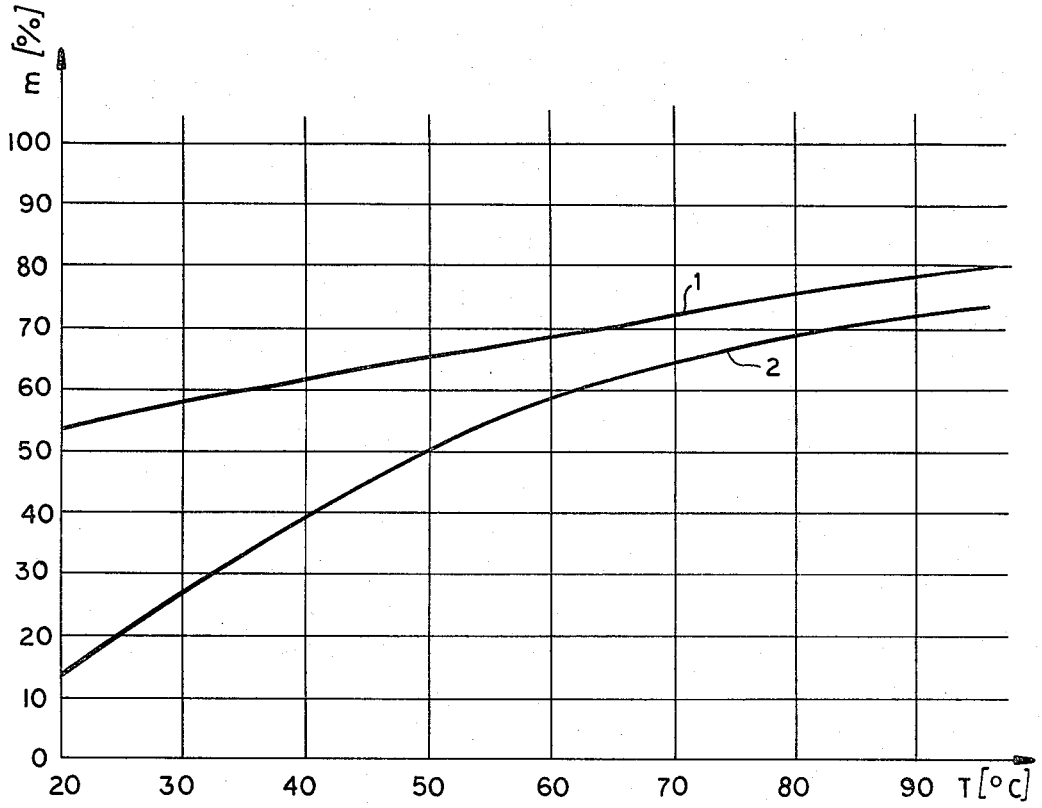
FIG. 1 is a diagram in which the temperature dependency of the extraction of a high-molecular-weight polymerizate by a benzine fraction from an aqueous monoethanolamine solution is illustrated.

In FIG. 1 the temperature is plotted in °C. along the abscissa while the quantity of high-molecular-weight polymerizate picked up by a benzene fraction is plotted along the ordinate.

In the diagram of FIG. 1, the monoethanolamine solution contains 3% by weight of monoethanolamine in water and the latter is extracted at various temperatures with a heavy pyrolysis gasoline fraction. The concentration of the polymerizate in the monoethanolamine solution prior to and after the extraction is plotted with the percent m of the extracted polymerizate being calculated. The curve 1 shows the treatment of a monoethanolamine solution which has not been regenerated after the latter has been charged with acid gases. Curve 2 shows the measured values for a previously regenerated monoethanolamine solution.

From the curves it will be apparent that the proportion of extracted polymerizate increases sharply with increasing temperature upon the treatment of the monoethanolamine solution with the heavy pyrolysis gasoline. The extraction treatment is the best close to a temperature of about 100° C. but extraction must be carried out below this temperature because boiling of the liquid mixture of monoethanolamine and pyrolysis gasoline begins at this temperature. The extraction treatment is shown by the diagram to be most effective prior to the regeneration of the scrubbing liquid.

The heavy pyrolysis gasoline used in the extraction process contains about 55% by weight $C_{9-12}$ aromatics, 14 weight% styrene and styrene derivatives, 5.5% by weight xylenes, 5.0% by weight toluene, 15.5% by weight benzene and benzene derivatives as well as 5.0% by weight of a mixture of various saturated and unsaturated partially substituted aliphatic and cyclic hydrocarbons with up to 10 carbon atoms. The specific gravity of this heavy pyrolysis gasoline at 25° C. is 0.913 kg/l.

Figure 2:
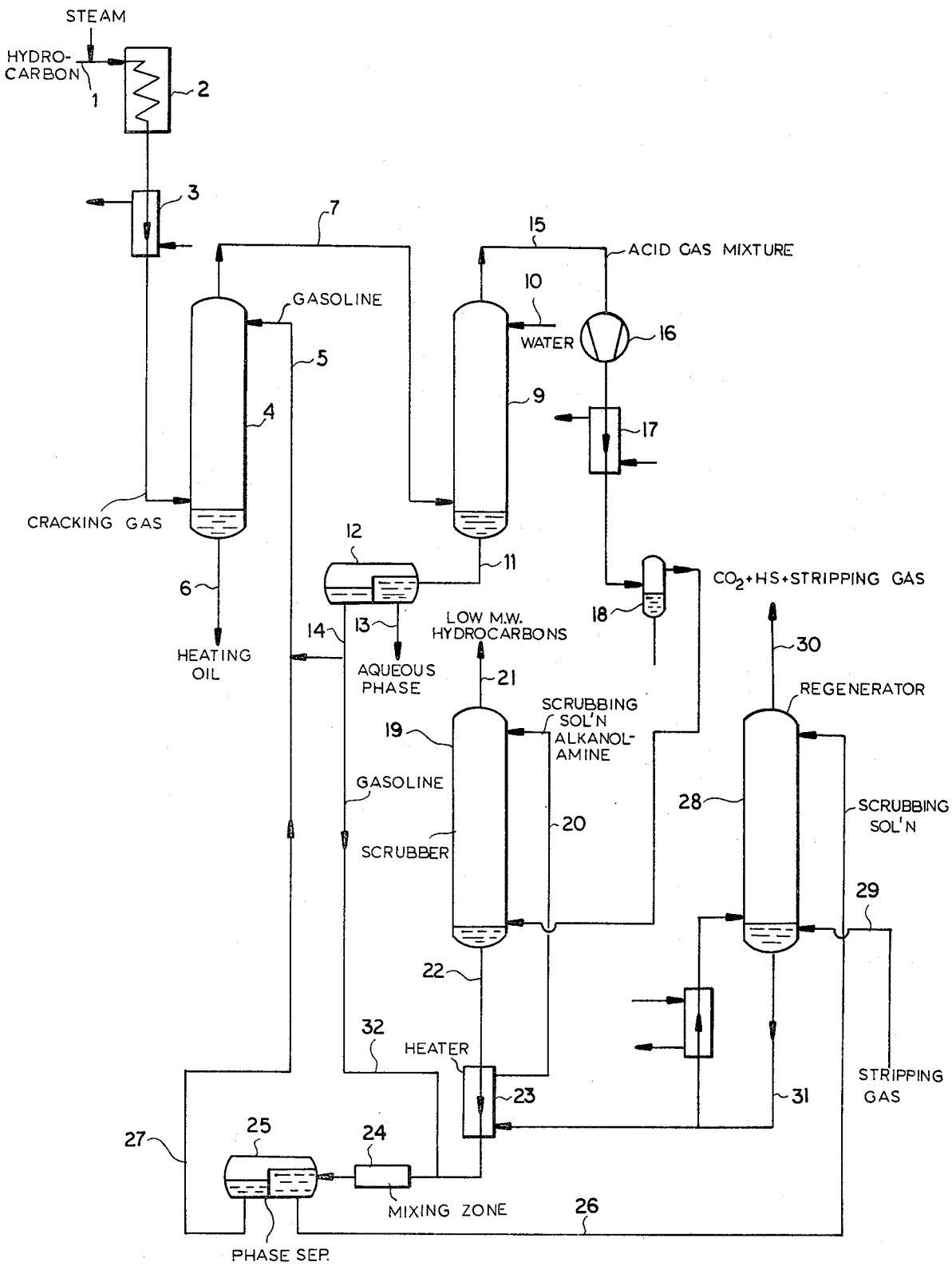
FIG. 2 is a flow diagram illustrating the process of the present invention as applied to gas mixtures arising from the cracking of hydrocarbon oils.

In the flow diagram of FIG. 2, a line 1 supplies a hydrocarbon mixture, for example naphtha, to a tube cracking furnace 2 in the presence of water vapor to bring about a cracking of the hydrocarbon. After cooling in the cooler 3, the cracking gas is delivered to a separating column 4 in which it is brought into contact with a liquid gasoline fraction supplied via line 5 to recover, as a sump product, a higher-boiling component liquid fraction, especially heating oil which is led off via line 6.

The gaseous phase, containing the carbon dioxide and hydrogen sulfide which will be subsequently scrubbed by the acid scrubbing operation described below, is led via line 7 to a column 9 to which wash water is supplied by a line 10 and from which a gasoline fraction is recovered at the sump. The gasoline fraction is led by a line 11 to a separator 12 in which the gasoline phase is carried via line 14 in part to the column 4 and in part to a line 32. The aqueous phase is discharged at 13.

From the head of the washing column 9, a line 15 carries the gas mixture from which carbon dioxide and hydrogen sulfide is to be removed, to a scrubber 19 in which the gas mixture is treated with the aqueous alkanolamine solution.

Prior to introduction into the scrubber 19, the gas mixture is compressed in the compressor 16, is cooled at 17 and is introduced into a separator 18 from which condensible components are removed. The condensible components are mainly water and hydrocarbons which can be separated in a unit similar to that shown at 12 and which can be part of a multistage system for recovering condensible components and separating them.

Regenerated scrubbing liquid is introduced into the scrubber 19 via line 20 to absorb the hydrogen sulfide and carbon dioxide so that the gases containing only a few ppm of these components can be discharged at 21 from the head of the column. The acid-gas-charged scrubbing liquid is recovered at the sump of the column 19 and is led via line 22 to a heat exchanger 23. The gases which have been purified and are removed at 21 can be separated by conventional techniques into individual light hydrocarbon fractions.

In the heat exchanger 23, the scrubbing liquid is subjected to indirect heat exchange with hot regenerated scrubbing liquid. The final temperature of the charged scrubbing liquid is slightly below the boiling point of the mixture to be formed between the scrubbing liquid and the gasoline fraction, serving as the extraction liquid, delivered by line 32 to the mixing zone 24 connecting the heat exchanger 23 with the separator 25.

The scrubbing liquid, still charged with carbon dioxide and hydrogen sulfide, but practically freed from the high-molecular-weight polymerizate, is separated from the gasoline fraction which is fed at 27 to the column 4. The scrubbing liquid is fed at 26 to a regenerating column 28. In the latter, heat is supplied at the column sump by recycling a portion of the sump product withdrawn at 31 through a heat exchanger, a stripping gas being introduced at 29 to drive off the absorbed carbon dioxide and hydrogen sulfide. The latter are withdrawn from the head of the column via line 30 together with the stripping gas. The regenerated hot scrubbing liquid is led away from the column 28 via line 31 and, after cooling in the heat exchanger 23, is fed at 20 to the alkanolamine scrubbing column 19. A distillation unit can be provided in line 27 if the extracting solvent is to be subjected to distillation in the manner described previously.

What is claimed is:

1. A method of scrubbing acid gases, comprising carbon dioxide and hydrogen sulfide, from a cracking gas mixture resulting from the cracking of a hydrocarbon mixture subjected to cooling and removal of higher boiling components in contact with a liquid gasoline fraction, a gaseous component being separated from said fraction to constitute said mixture and containing polymerizable organic components, which comprises the steps of:

(a) scrubbing the gas mixture, from which condensible substances have been removed by cooling, with an aqueous alkanolamine scrubbing solution;

(b) heating the scrubbing solution following step (a) to an extraction temperature above 60° C. by indirect heat exchange;

(c) treating the heated scrubbing solution of step (b) with a water immiscible organic solvent to extract polymerizable components from the scrubbing liquid at a temperature above 60° C. but below the boiling point of the resulting mixture of the scrubbing liquid and organic solvent, said solvent being a portion of said liquid gasoline fraction;

(d) regenerating the scrubbing liquid following step (c);

(e) cooling the regenerated scrubbing liquid;

(f) recycling the regenerated scrubbing liquid from step (e) to step (a); and (g) returning the liquid gasoline fraction following extraction in step (c) to the separation stage of the high boiling component from the cooled cracking gas.

2. The method described in claim 1, further comprising the steps of:

(h) removing the polymerizable components from said organic solvent; and (i) recycling the organic solvent from which the polymerizable components have been removed to step (c).

3. The method defined in claim 1 wherein said scrubbing liquid is a highly aqueous monoethanolamine solution and the organic solvent has a boiling point above 100° C., the extraction in step (c) being carried out at a temperature above 60° C.

4. The method defined in claim 3 wherein the extraction temperature in step (c) is above 80° C.

5. The method defined in claim 1 wherein the organic solvent following step (c) contains the polymerizable components at least in part in the form of high molecular weight polymerizate, said method further comprising the steps of subjecting the organic solvent containing high molecular weight polymerizate to a distillation stage and recovering the high molecular weight polymerizate in the sump of the distillation stage while removing organic solvent from the head of the distillation stage and recycling same to step (c) together with alkanolamine originally entrained from step (c) with the organic solvent.

* * * * *